US006186078B1

(12) United States Patent
Brown

(10) Patent No.: US 6,186,078 B1
(45) Date of Patent: Feb. 13, 2001

(54) LOW PROFILE MATERIAL HANDLING PLATFORM

(75) Inventor: Henry F. Brown, Portage, WI (US)

(73) Assignee: Alltrista Corporation, Indianapolis, IN (US)

( * ) Notice: Under 35 U.S.C. 154(b), the term of this patent shall be extended for 0 days.

(21) Appl. No.: 09/430,486

(22) Filed: Oct. 29, 1999

(51) Int. Cl.[7] ..... B65D 19/22
(52) U.S. Cl. ..... 108/57.25; 108/55.1; 248/346.02
(58) Field of Search ..... 108/51.4, 55.3, 108/55.1, 55.5, 57.25; 248/346.02

(56) References Cited

U.S. PATENT DOCUMENTS

| | | | | |
|---|---|---|---|---|
| 2,615,661 | | 10/1952 | Cushman . | |
| 3,229,836 | | 1/1966 | Koenig . | |
| 3,707,127 | | 12/1972 | Palfey . | |
| 3,720,176 | * | 3/1973 | Munroe | 108/57.25 X |
| 3,850,116 | | 11/1974 | Mackes . | |
| 4,832,562 | | 5/1989 | Johnson . | |
| 5,111,754 | * | 5/1992 | Adams, Jr. | 108/51.3 |
| 5,226,372 | | 7/1993 | Frenkel et al. . | |
| 5,503,517 | | 4/1996 | Derby . | |
| 5,687,652 | | 11/1997 | Ruma . | |
| 5,720,229 | * | 2/1998 | Schrage | 108/55.5 |
| 5,813,355 | | 9/1998 | Brown et al. . | |

* cited by examiner

*Primary Examiner*—Peter R. Brown
*Assistant Examiner*—Michael J. Fisher
(74) *Attorney, Agent, or Firm*—Lathrop & Clark LLP

(57) ABSTRACT

A deck is defined by closely spaced molded ribs with pairs of ramped tine entry openings molded adjacent each edge which are tapered to provide maximum clearance. A narrow lip extends at an angle upwardly from each edge, permitting the platform to be engaged and manipulated by conventional slip sheet handling equipment, while the tine entry ramps permit a powered forklift truck to engage its fork tines beneath the platform. To facilitate deflection of the platform ribs on entry of the forklift tines, the ribs in the path of the tines may have curved valleys, while ribs not in the path may have generally square valleys. The platform may also be constructed through twin sheet thermoforming, foam molding, corrugated paperboard assembly. The platform has a horizontal load support deck with side walls which extend downwardly. Two tine inlet access openings are defined in each side wall, with the height of each access opening being less than the maximum height of a forklift tine. Downwardly opening channels extend between each pair of tine access openings on the opposite side walls and are separated by downwardly extending support pads. A lip extends upwardly and outwardly from the support pads on each side of the platform, and each lip has a clearance opening in front of an access opening to permit the forklift times to pass through the lip and into engagement with the channels. The platform may also be inverted to serve as a load cap.

14 Claims, 8 Drawing Sheets

LOW PROFILE MATERIAL HANDLING PLATFORM

CROSS REFERENCES TO RELATED APPLICATIONS

STATEMENT AS TO RIGHTS TO INVENTIONS MADE UNDER FEDERALLY SPONSORED RESEARCH AND DEVELOPMENT

BACKGROUND OF THE INVENTION

The Present invention relates to material handling platform in general, and more particularly to reduced height load supports.

Shipping and Storage are significant cost components of any product which must make its way from a manufacturer to an end user. The bundling of multiple items into uniform loads with associated structure for engagement by material handling equipment such as forklift trucks has permitted a degree of automation and repeatability in the transportation of goods.

For many years uniform or "palletized" loads were built upon wooden pallets. The wooden pallet is very stiff, is manufactured from commonly available low cost material, and provides a large vertical clearance to receive the metal tines of a forklift truck or the wheeled tines of a hand truck. More recently, plastic pallets have been substituted for wooden ones in view of their greater consistency, usable life, and nestability.

For some loads, however, the high profile of the wooden or plastic pallet, approximately 4–5 inches, represents an unacceptable increase in the shipping volume of the product. This is a particular concern in automated loading applications, such as on railway freight cars, where excessive vertical height of the palletized load of even a few inches might limit the number of stackable units to two levels, rather than three. To minimize support height, loads may be placed on narrow slip sheets, which provide no clearance for fork tines. The conventional slip sheet may be formed of corrugated paperboard, or an extruded or molded plastic sheet, which may have a corrugated paperboard sheet adhesively attached thereto. The slip sheet is typically wider than the load supported thereon, extending outwardly in an upwardly extending lip. In addition to being of lower volume, slip sheets are usually of lower cost than a full height pallet.

Where slip sheet mounted loads are widely used, material handling facilities are outfitted with specialized forklift trucks which have mechanisms for clamping on to the slip sheet lip and dragging the load onto the forklift tines. The slip sheet supported load is usually discharged from the truck by a vertical panel actuated by a scissors joint linkage which pushes the load off the tines.

The conventional slip sheet has several limitations. First, because of its very low-profile, generally from ⅛ in. to ¼ in., its rigidity is low, and its resistance to warping, twisting, bending, and folding is correspondingly low. This susceptibility to damage in shipping makes re-use problematic. Second, the narrow sheet provides minimal isolation of the supported load from support surface irregularities such as gouges, cracks, loose hardware, splinters and the like commonly found in semi truck trailers, rail cars, and factory floors. The nonrigid slip sheet also provides minimal load distribution of the lifting fork tines. The load is thus open to damage from the concentrated impact of the material handling equipment. Third, facilities which handle primarily loads on high-profile pallets or skids may not be equipped with specialized slip sheet handling equipment. In some situations a slip sheet supported load may be engaged by conventional powered forklift trucks by ramming the tapered tines beneath the slip sheet lip. This approach offers significant opportunity for product damage.

What is needed is a low-profile load support which provides some protection for the load from support surface irregularities and load handling impact, and which is readily engaged by conventional fork lift equipment.

SUMMARY OF THE INVENTION

The material handling support platform of this invention has structure permitting it to be manipulated by fork lift trucks which are outfitted with conventional slip sheet engaging accessories, or by fork lift trucks with bare tines without such accessories. The platform is of much lower profile than a conventional wooden pallet or a conventional nine leg plastic pallet. The platform may be manufactured as a single sheet thermoformed thermoplastic part having a deck defined by closely spaced molded ribs. Pairs of ramped tine entry openings are molded adjacent each edge of the platform. The tine entry ramps are tapered to provide maximum clearance at the edge. However, the maximum height of the opening is less than the maximum thickness of a forklift tine. A narrow lip extends at an angle upwardly from each edge, permitting the platform to be engaged and manipulated by conventional slip sheet handling equipment. The tine entry ramps, however, permit a powered forklift truck to engage its fork tines beneath the platform. To facilitate deflection of the platform ribs on entry of the forklift tines, the ribs in the path of the tines may have curved valleys, while ribs not in the path may have generally square valleys.

The platform may also be constructed through alternative manufacturing processes, such as twin sheet thermoforming, foam molding, corrugated paperboard assembly, or others. In general, the platform has a horizontal load support deck with side walls which extend downwardly. Two tine inlet access openings are defined in each side wall, with the height of each access opening being less than the maximum height of a forklift tine. Downwardly opening channels extend between each pair of tine access openings on the opposite side walls and are separated by downwardly extending support pads. A lip extends upwardly and outwardly from the support pads on each side of the platform, and each lip has a clearance opening in front of an access opening to permit the forklift times to pass through the lip and into engagement with the channels. The platform may also be inverted to serve as a load cap. As a load cap, the platform pads may be provided with projections which engage with recesses on an overlying platform. In such an application the height of the tine access openings would be selected such that a forklift tine could be fully received between the two overlying access openings and channels to permit an overlying loaded platform to be removed by a forklift vehicle without disturbing the underlying load.

It is an object of the present invention to provide a material handling support platform which can be readily engaged by a forklift truck with or without slip sheet handling attachments.

It is also an object of the present invention to provide a low profile material handling support platform which is reusable and recyclable.

It is another object of the present invention to provide a low-cost material handling support platform.

It is a further object of the present invention to provide a low-profile material handling support platform which is adapted to manipulation by automated equipment.

It is an additional object of the present invention to provide a material handling support platform which can be manipulated by slip sheet handling equipment, yet which minimizes disturbance of the supported goods.

It is yet another object of the present invention to provide a material handling support platform which isolates the supported load from irregularities in the shipping or storage support surface.

Further objects, features and advantages of the invention will be apparent from the following detailed description when taken in conjunction with the accompanying drawings.

DESCRIPTION OF THE PREFERRED EMBODIMENTS

Figure 1:
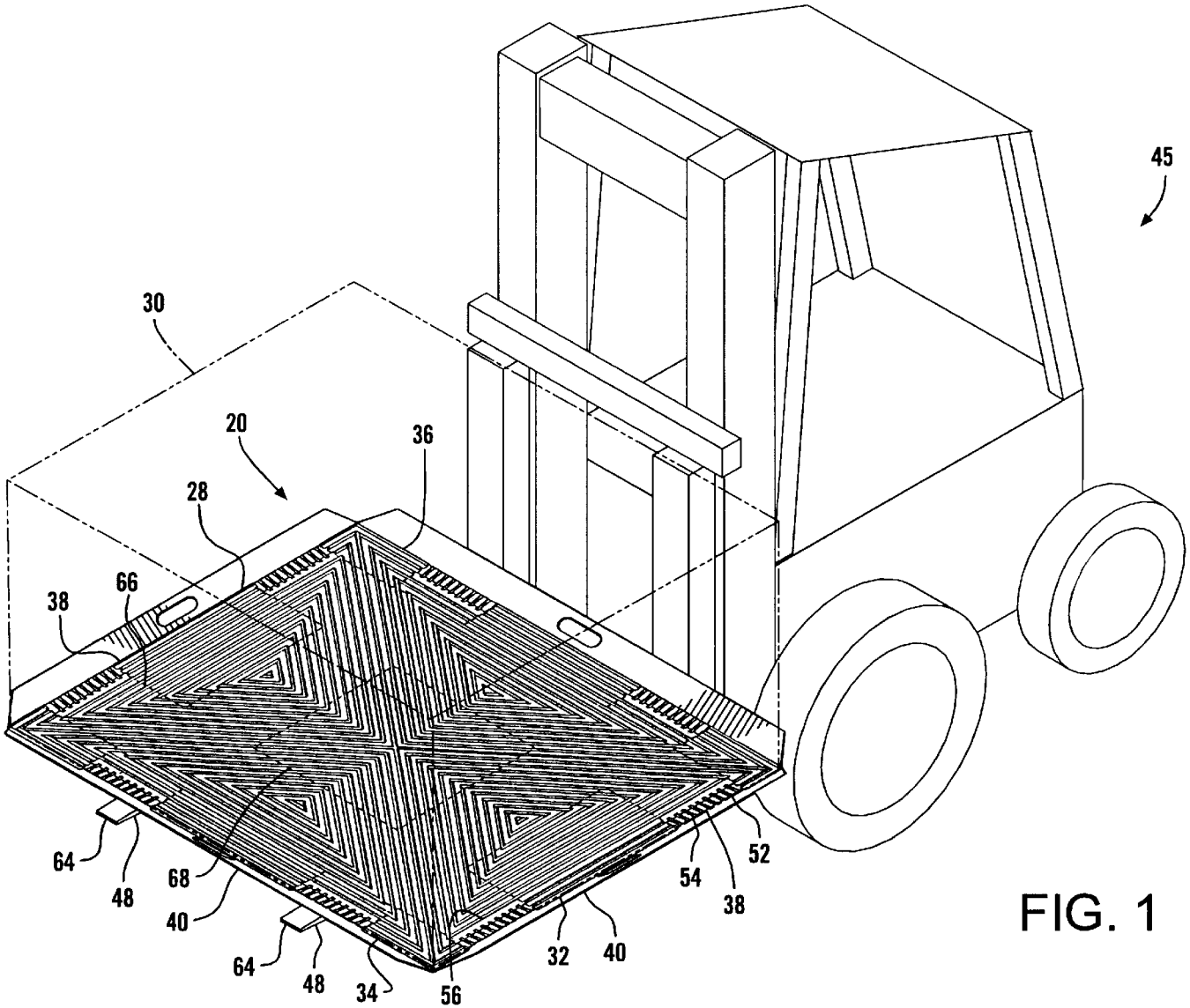
FIG. 1 is a top isometric view of the load support platform of this invention being carried on a powered forklift truck, with a load shown in phantom view.

Referring more particularly to FIGS. 1–15, wherein like numbers refer to similar parts, a material handling load support platform 20 is shown in FIGS. 1–5. The platform 20 is formed from a unitary sheet of plastic. The platform 20 may be formed from a single sheet of thermoplastic material such as polyethylene in the vacuum thermoforming process. In the single sheet thermoforming process, an extruded thin sheet of plastic is heated and brought into contact with a mold which has been provided with multiple air passages. The heated sheet engages the mold while air is drawn through the passages to cause the plastic to conform to the shape of the mold. The molded sheet is cooled, removed from the mold, and trimmed and routed as necessary. Alternatively, the platform 20 could be made as an injection molded part.

The platform 20 has an array of ribs 22 spaced by valleys 24. The top surfaces 26 of the ribs 22 extend in a common horizontal plane to define a support deck 28 which receives a load 30 of goods. The load 30 will typically have the capacity to retain its own integrity, either by being encased in a single carton, or, if multiple smaller containers form the load, by being shrink-wrapped in plastic, or otherwise strapped together. The deck 28 is terminated by a rectangular perimeter 32 defined by a front edge 34 which is parallel to a rear edge 36, and two parallel side edges 38. The support deck 28 will typically have dimensions of a standard slip sheet or pallet, for example 40 inches by 48 inches.

To permit the platform 20 to be manipulated by conventional slip sheet handling equipment, plastic tabs or lips 40 extend upwardly and outwardly from each edge 34, 36, 38. Each lip 40 is about 3 inches wide and extends the length of the edge. The lips extend upwardly from the support deck 28 at an angle of 10–30 degrees and are thereby readily graspable by mechanical equipment. To provide for convenient manual handling of the unloaded platforms 20, each lip 40 may be provided with one or more hand holes 44.

Figure 5:
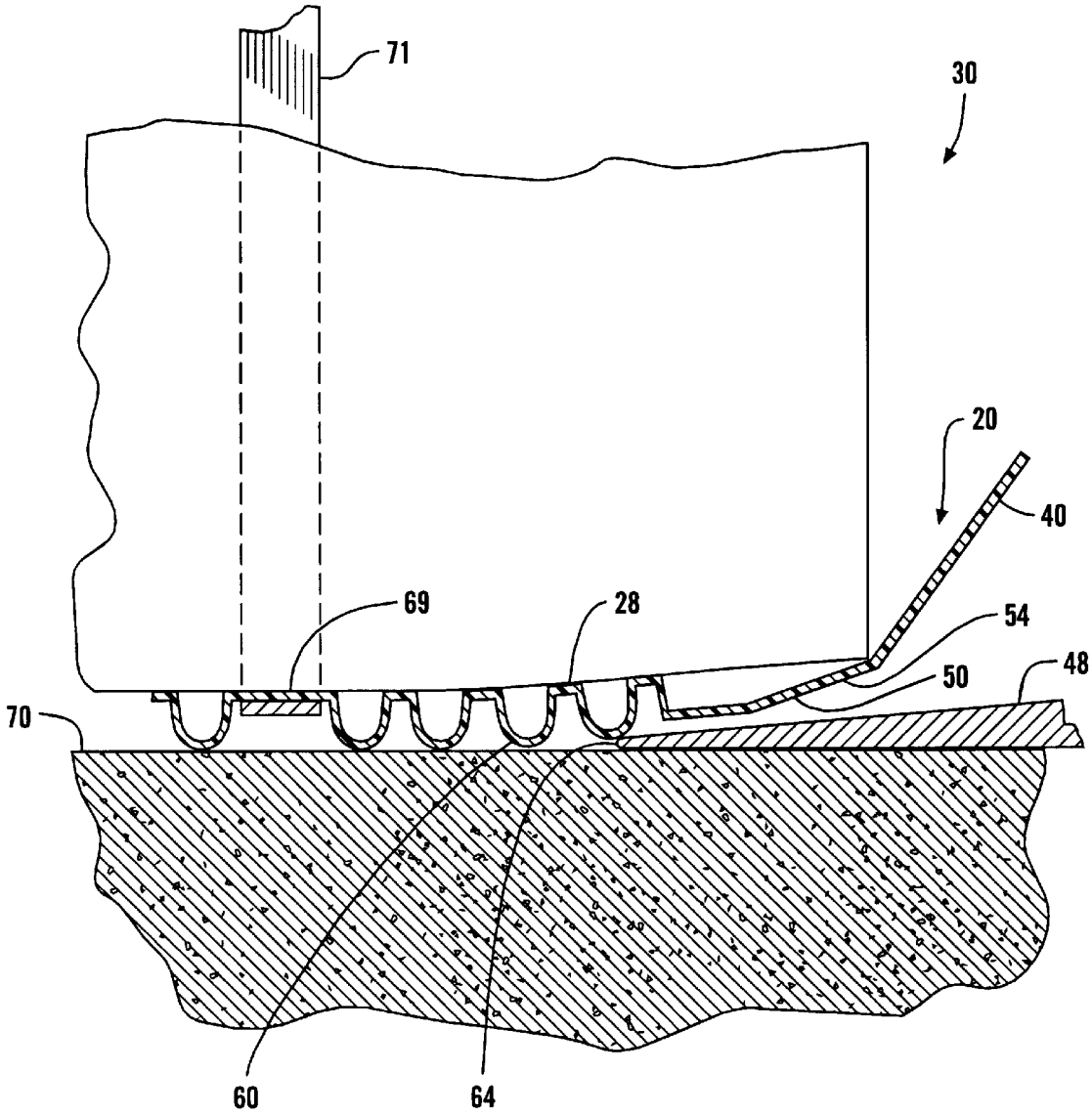
FIG. 5 is a fragmentary cross-sectional view of a modified load support platform, similar to the one of FIG. 1 being engaged by the tines of a forklift truck.

The platform 20 may be manufactured in various thicknesses depending upon the requirements of a particular application. The illustrated platform 20, as shown in FIG. 5, has a height from the top surfaces 26 of the ribs 22 to the lower surfaces 42 of the valleys 24 of approximately ⅜ inches. Such a platform is expected to be adequate for supporting loads of about 2,500 pounds on a single pallet, and, when at the base of a four platform-load stack, 10,000 pounds.

Figure 3:
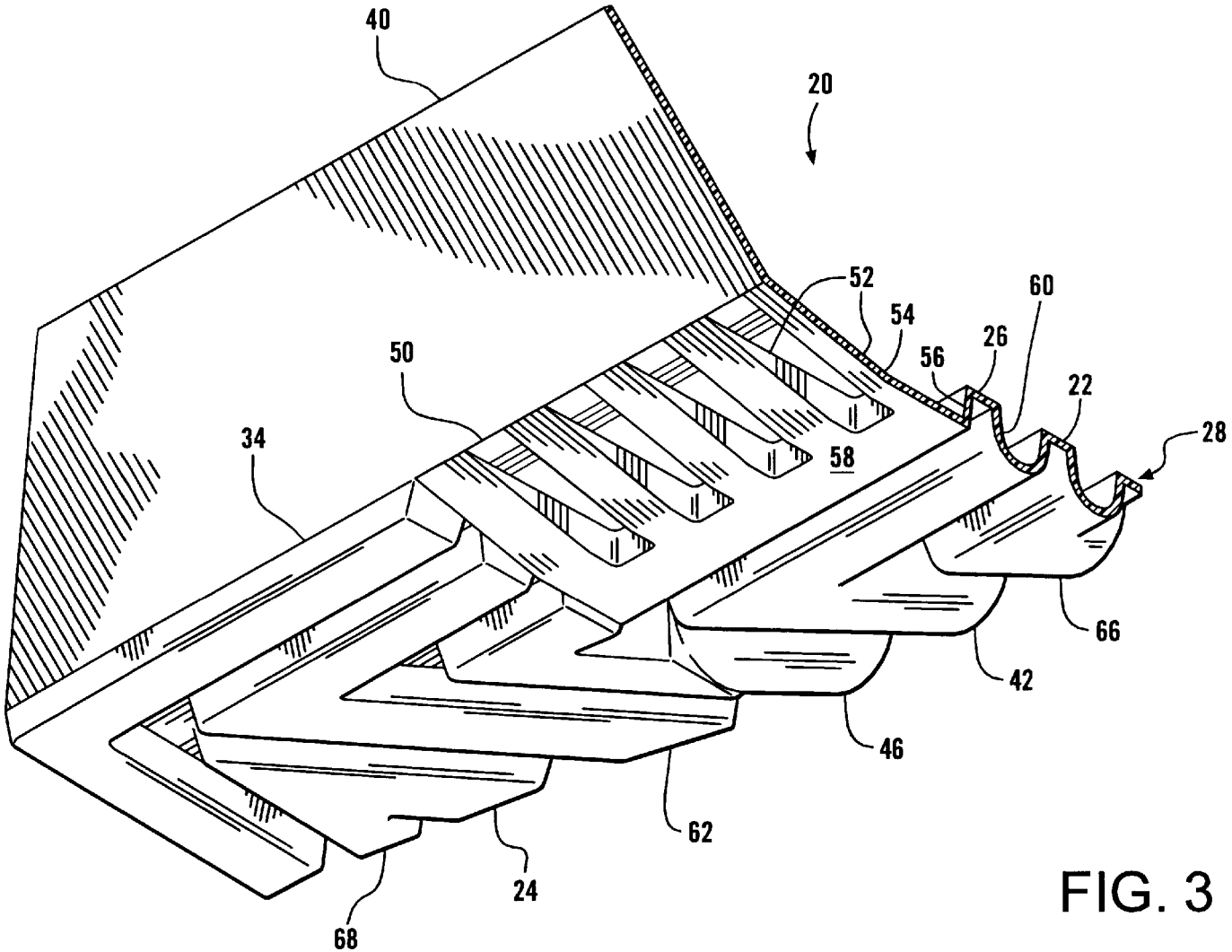
FIG. 3 is a fragmentary bottom isometric view of the load support platform of FIG.1.

To permit the platform 20 to be manipulated by a forklift truck 45 which is not outfitted with slip sheet handling equipment, certain ribs are configured to assist entry of bare forklift tines 48 beneath the lower surface 46 of the platform 20 defined by the lower surfaces 42 of the valleys 24. First, to assist initial engagement between the forklift tines 48 and the platform 20, pairs of tine entry openings 50 are formed on each edge 34, 36, 38. As shown in FIG. 3, each tine entry opening 50 is comprised of a plurality of tapered ribs 52 extending generally perpendicular to the edge. The group of tapered ribs 52 defines an inverted ramp 54 which extends downwardly away from the support deck 28 as the ramp extends inwardly from the edge. The tapered ribs 52 terminate at and are joined by a perpendicular terminal rib 56. The terminal rib 56 may have a lower surface 58 which is in the same plane as the lower surfaces 42 of the valleys 24, or, preferably as shown in FIG. 3, the terminal rib lower surface will be slightly recessed from the lower surfaces of the platform valleys generally. Each ramp rib 52 extends approximately 1½ inches from the perimeter edge to the terminal rib. Each inverted ramp 54 extends approximately 7.5 inches along the edge to accommodate the approximately four inch to six inch width of a conventional forklift tine 48. A forklift tine 48 may be 48 inches or longer and have a maximum thickness of 1¼ in. to 2 inches. However, the entry end or tip 64 of the forklift tine 48 may be only 3/16 inches thick, with the tine increasing in thickness over a tapered length of about 18–20 inches. Thus, although the tine entry opening 50 in the illustrated embodiment is less than 3/8 inches high, the tip 64 of the time readily enters therein.

Figure 4:
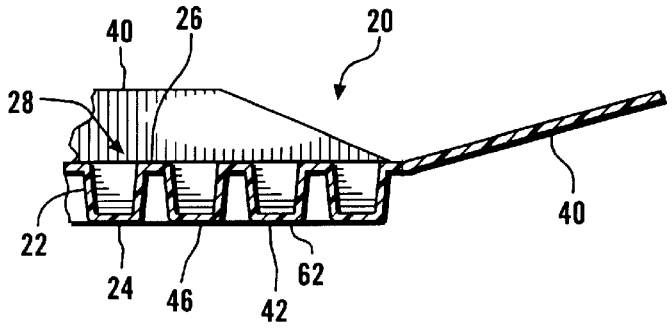
FIG. 4 is a fragmentary cross-sectional view of the load support platform of FIG. 2 taken along section line 2—2.
Figure 2:
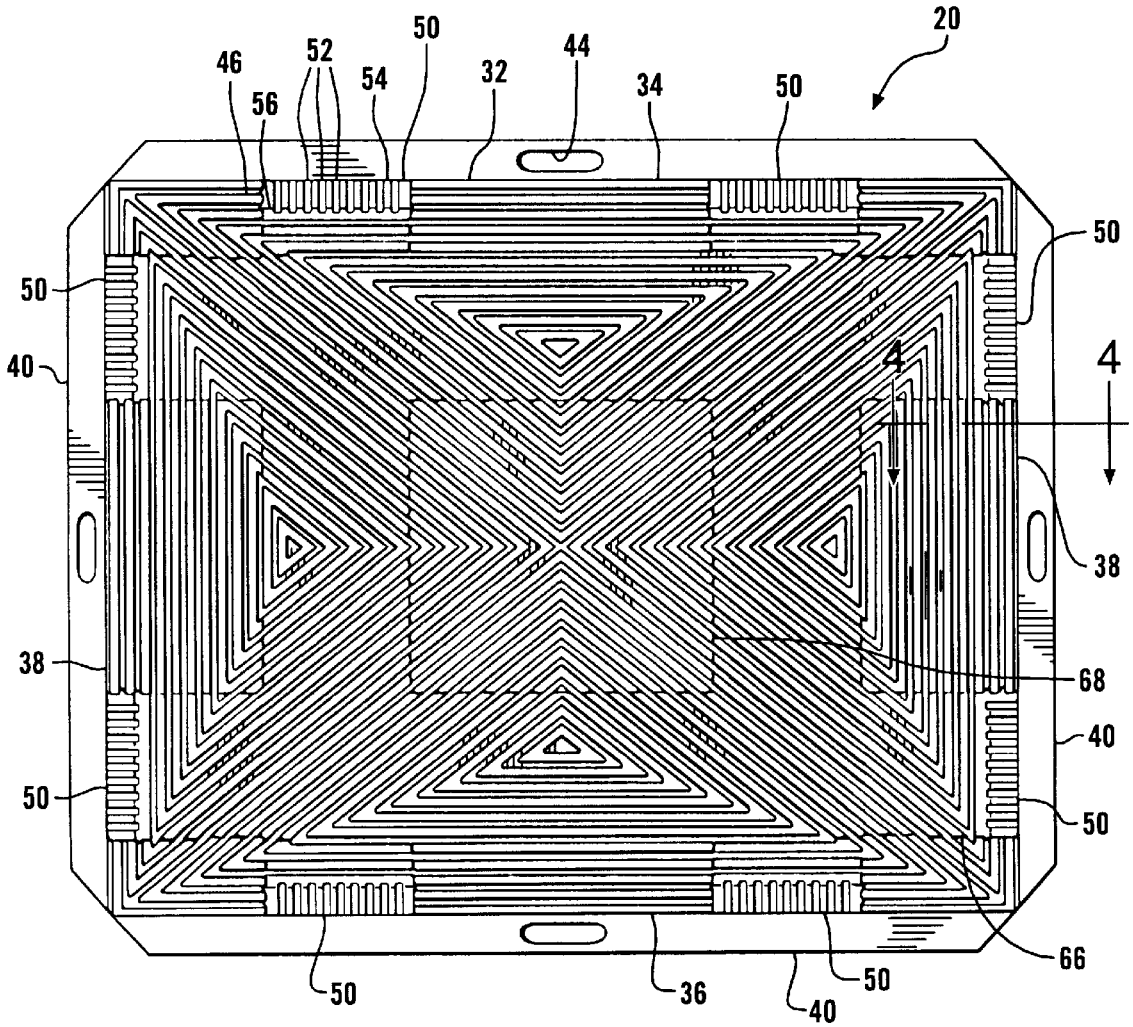
FIG. 2 is a bottom plan view of the load support platform of FIG. 1.

To facilitate the elevation of the platform onto the tines 48, which will typically be taller than the inlet entry to the support platform 20 itself, the ribs are formed to readily deflect as the tines enter. As shown in FIG. 5, the valleys 60 between ribs 22 which are in the path of a tine 48 have a generally rounded cross-section. The valleys 62 between ribs 22 which are not in the path of a tine, on the other hand, as shown in FIG. 4, have a generally square cross-section. Although many rib patterns are possible, the rib pattern shown in FIG. 2 is designed to cushion the load when supported on irregular support surfaces, to absorb shock vibration during transport, and to avoid ribs which run parallel to the forklift tines where possible. The performance of the platform as far as absorbing shock may be adjusted by modifying the attributes of the ribs, including the draft angle of the rib, the thickness of the walls of the rib, the shape of the rib—whether more rounded or more square—, and the number and spacing of the ribs. Depending on the size of the load to be supported, and the level of dynamic shock absorption these features may be varied.

As indicated, the valleys between ribs may be categorized as those which may be contacted by a tine, and those which should not be contacted by a tine. The underside of the platform 20 may thus be divided into two regions, a tine engagement region 66 which encompasses all the rounded valleys 60, and a second region 68 which will typically not contact a time and which encompasses all the square valleys 62. The tine engagement region 66 extends in overlapping rectangular bands between the tine entry openings 50. The second region 68 comprises the comers, the perimeters areas between the two tiny entry openings 50 along one edge, and a rectangular region in the center.

The platform 20 is configured to allow it to be approached from any of its four edges. Hence, portions of the tine engagement region 66 may be expected to engage a tine extending in two perpendicular directions. Thus the tine engagement region 66 has a plurality of diagonal ribs extending from a comer of the platform to the center, with the results that many of the curved valleys will engage the forklift tines 48 obliquely. The rib pattern minimizes any fold lines or weak lines, for increased rigidity.

The platform 20 has several advantages. First, the ribbed configuration absorbs some of the shock and vibration of transportation. Second, the platform provides greater distance between the load and any loadbearing surfaces that have irregularities. There are many occasions in which a palletized load can encounter surface irregularities which are potentially damaging to the load. For example, oftentimes the platform may be slid onto a wooden pallet, and then the unit load is transported with conventional pallet handling equipment. The platform 20 provides some protection for its contents from normal wood skids, nail heads, and slivered and broken boards, which could easily deform or ruin the contents. Truck trailer bottoms and rail car bottoms also may have irregular conditions. Over many uses and loading cycles, trucks and rail car bottoms may be gouged or otherwise damaged by the downward angling of lift truck tines.

The platform 20 may be handled both as a slip sheet with conventional slip sheet handling equipment, and by a forklift truck without such equipment. However, the platform 20 offers greater separation from the load to the load bearing surfaces than a conventional uniform thickness plastic slip sheet. As shown in FIG. 5, as the forklift tines 48 engage the valleys 60, the plastic of the platform 20 deflects, raising the load, and creating clearance for entry of the tines. When the tines are fully engaged with the lower surface of the platform 20, as shown in FIG. 1, the portions contacting the tines are elevated above the floor or other support surface. Because of the shallow depth of the platform 20, a certain amount of deflection will occur between the two tines. The platform will not remain perfectly flat. The load may cause the platform to contact the floor 70 between the tines and offer some resistance. This frictional resistance between the under surface of the platform 20 and the floor is very helpful when it is desired to unload the platform from the forklift tines 48. Because the platform bows between the tines 48, the lower surface 46 between the tines engages the floor 70 before the tines themselves touch the floor. Therefore, the frictional engagement of the platform 20 with the floor 70 over a wide area can be greater than the frictional engagement forces between the platform and the tines 48, permitting the tines to be extracted from the platform, and the platform to be disengaged from the forklift truck. This disengagement is most expeditiously obtained by tilting the forklift tines downwardly and backing up the truck, thereby gradually retracting the tines from engagement beneath the platform 20. This technique may also be used to set a platform-mounted load on another load.

It should be noted that the platform top surface may be formed with shallow protrusions, for example approximately 1/32 inch tall, projecting upwardly from the rib top surfaces 26, which serve to mechanically engage the load disposed on the platform. The protrusions may have a surface appearance similar to grip plate, such as the pattern of ribs shown in FIG. 15, of U.S. Pat. No. 5,566,624, the disclosure of which is incorporated by reference herein.

It should be noted that the platform made from conventional plastic materials, such as polyethylene, could also be provided with a slip resistant surface for particular applications. The slip resistant surface may be provided on the top or the bottom or on both surfaces. The slip resistant surface may be co-extruded with the initial plastic sheet, or it may be sprayed on after molding. Examples of non-slip coatings are found in U.S. Pat. Nos. 4,693,507 and 4,428,306, the disclosures of which are incorporated by reference herein.

In certain applications, for example the shipment of containers of granular or liquid material, the platform 20 has the advantageous attribute of restricting flow of material beyond the confines of the platform. As best shown in FIG. 1 and FIG. 4, the platform 20 support deck 28 is unperforated, and the edges are all elevated above the level of the floor 70. Hence, should a supported beverage can burst or be crushed, the liquid—at least in limited quantities—can be contained within the valleys of the support deck. This spillage containment serves to prevent structural damage to one load being the cause of liquid damage to a load below. Although the valleys of the support deck have been shown as discrete and non-connected, a labyrinthine pattern of connected ribs could also be employed, thereby facilitating the equal distribution of a spilled liquid throughout the platform surface.

The platform 20 in FIG. 5 has been shown modified from the platform of FIGS. 1–4 in one respect, in that a flat wide rib 69 is provided running parallel to an edge of the platform. The wide rib 69 extends in the plane of the top deck 28, elevated above the valleys 24. Thus a strap 71 which is wrapped around the load 30 supported on the platform 20 extends beneath the wide rib 69, thereby securing the load to the platform, while at the same time retaining the strap 71 out of potential engagement with the incoming forklift tine 48. Similar flat wide ribs may be provided parallel to each edge of the platform.

An alternative embodiment platform 72 of this invention is shown in FIGS. 6–10. The platform 72 is formed of thermoplastic sheets in the twin sheet thereof forming process. In the twin sheet thermoforming process a first extruded thermoplastic sheet is heated and molded in a lower vacuum forming mold, while a second extruded thermoplastic sheet is heated and molded in an upper vacuum forming mold. The two molded sheets, while still hot, are brought together and fused at selected locations to form a single part. The part is cooled and ejected from the molds where it is cut and trimmed. The twin sheet thermoforming process is particularly effective in producing stiff parts with minimal plastic material.

Figure 6:
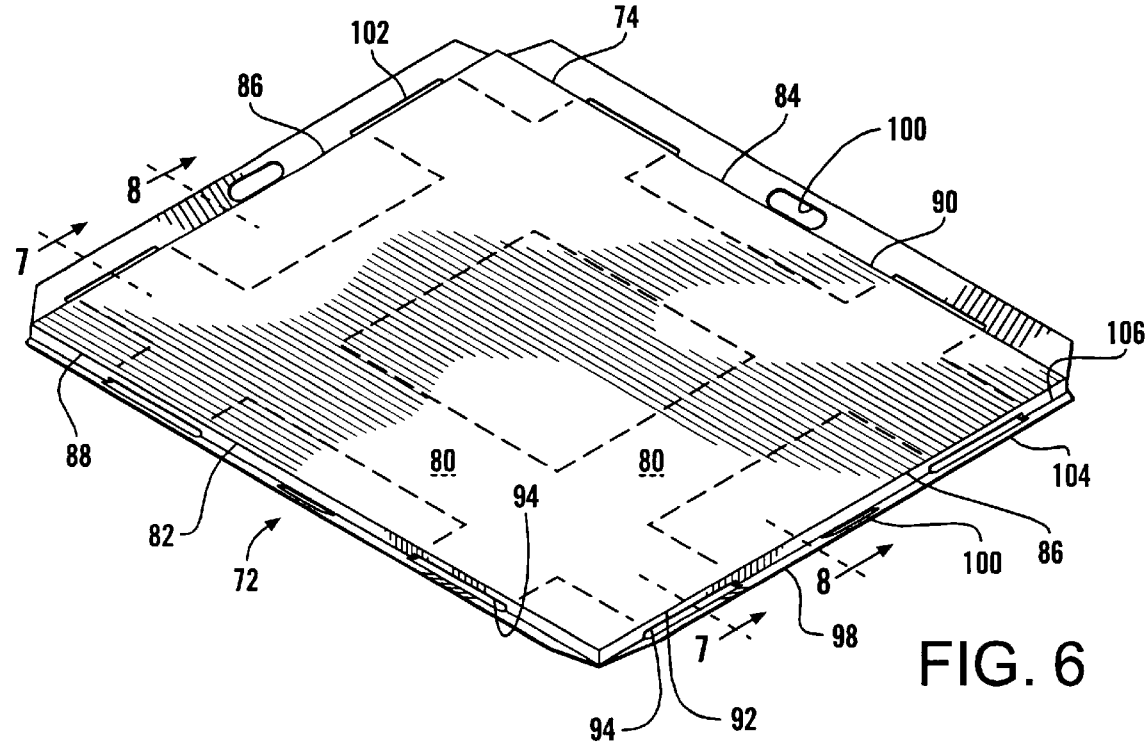
FIG. 6 is a top isometric view of an alternative embodiment twin sheet thermoformed load support platform of this invention.

As shown in FIG. 6, the platform 72 may be formed with a load support deck 74 which has a substantially featureless upwardly facing top surface 76. The platform 72 may be of the same height as the platform 20, however for added load isolation it may be thicker, for example about 1½ inches from the top surface 76 to lower engagement regions 78 on the underside of the deck 74 spaced beneath and parallel to the top surface. As is common in twin sheet thermoformed structures, the lower sheet may be formed into an array of ribs which are fused to the flat upper sheet. The rib structure may be a pattern of angled ribs similar to the array shown in FIG. 2. Although, it should be noted that the width and spacing of ribs will vary with the depth of the deck 74, i.e.: deeper decks will have ribs which are wider and lesser in number. Other rib patterns, for example those involving longitudinally aligned ribs which are fused to one another, such as those shown in U.S. Pat. No. 5,566,624, the disclosure of which is incorporated by reference herein The deck has a front edge 82, a rear edge 84 spaced parallel to the front edge, and two side edges 86 which extend between the front edge and the rear edge. A front wall 88 extends from the front edge 82 between the top surface 76 and the lower engagement regions 78. A rear wall 90 extends downwardly from the rear edge 84, and side walls 92 extend downwardly from the side edges 86. Two tine inlet openings 94 are formed in each of the front wall 88, rear wall 90, and side walls 92. The tine inlet openings 94 on opposite side walls are aligned with one another.

Figure 7:
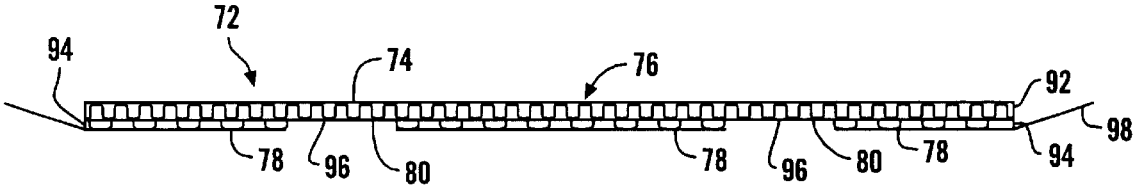
FIG. 7 is a cross-sectional view of the load support platform of FIG. 6 taken along section line 7—7.
Figure 8:
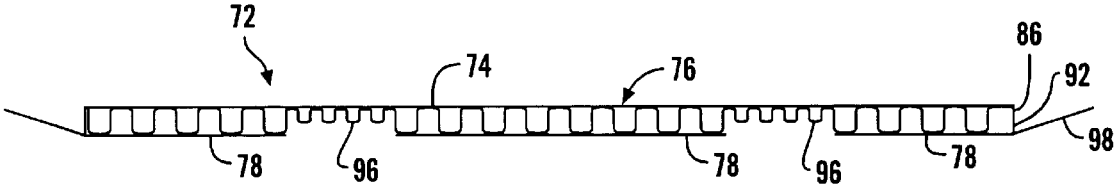
FIG. 8 is a cross-sectional view of the load support of FIG. 6 take along section line 8—8.
Figure 9:
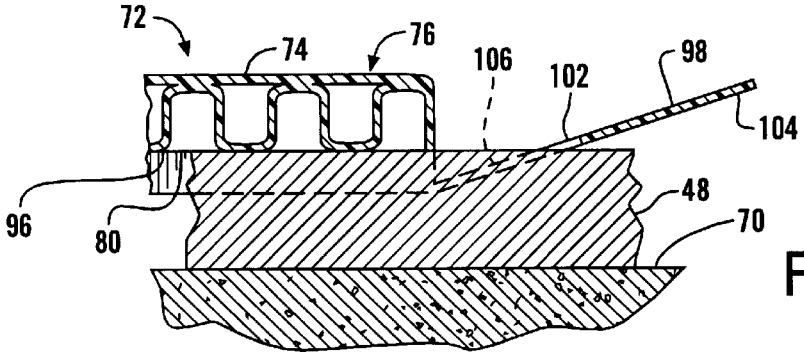
FIG. 9 is a fragmentary cross-sectional view of the load support platform platform of FIG. 6 engaged and elevated on the tines of a fork lift truck.

The platform 72 has downwardly opening channels 80 formed in the underside of the deck 74. Each channel 80 extends between a tine inlet opening 94 on one wall beneath the deck to the tine inlet opening on the opposite wall. As shown in FIGS. 7 and 8, the channels 80 extend all the way across the underside of the platform 72 and two sets of two channels intersect each other providing four way entry to the underside of the deck 74 as shown in FIG. 9, the recessed channels 80 are significantly shallower than the height of a forklift tine 48. For example, the height of the deck 74 may be 1.5 inches, while the depth of the channels is about 0.5 inches. The tine inlet openings 94 need not be provided with ramps, because the tips 64 of the forklift tines 48 are themselves tapered, and the height of the inlet openings allows the tines to make initial entry into the channels 80. However, as an aid to the tines finding the tine inlet, the deck 74 may be provided with inverted ramps at each tine inlet opening 94. As the powered lift truck advances on the platform 72 the tines 48 are driven into the channels and the platform is elevated. The tines 48 make contact with tine engagement surfaces 96 which define the uppermost downwardly facing portions of the channels 80.

To allow the platform 72 to be manipulated by conventional slip sheet handling equipment, a lip 98 extends upwardly and outwardly from each of the front wall 88, the rear wall 90, and the side walls 92. The lips 98 extend from the deck 74 at a position spaced below the top surface 76, preferably at a level close to the ground engagement regions 78. As in the platform 20, the lips 98 extend at 10–30 degrees and are 3–4 inches long. The lips 98 are provided with hand holes 100 for manual maneuvering of the unloaded platforms 72. To allow the forklift tines 48 to enter the tine inlet openings 94, clearance openings 102 are defined in each lip adjacent the tine inlet openings.

Figure 10:
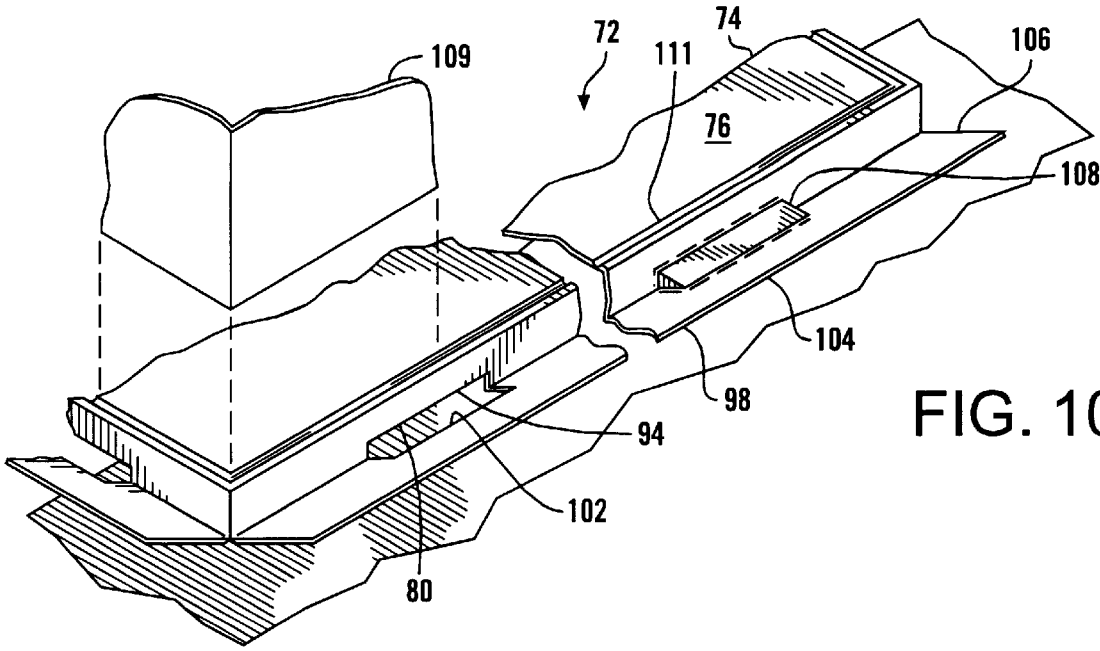
FIG. 10 is a fragmentary enlarged isometric view, partially broken away in section, of the lip of a load support platform similar to the one of FIG. 6, but provided with a groove for engaging a pallet sleeve, and showing portions in an as-molded condition prior to routing and trimming.

The clearance openings 102 allow the forklift tines 48 to pass beneath the lip 98 and extend into the channels 80 for engagement with the tine engagement surfaces 96 of the deck 74. To permit this, the clearance openings 102 should extend vertically about as high as the level of the tine engagement surfaces 96. Each lip 98 thus has a continuous strip 104 joined to the deck 74 by three connecting segments 106. As shown in FIG. 10, for convenience of thermoforming and manufacture, the tine inlet openings and lip access openings 102 may be covered in the as-molded part by a cap 108. The surrounding wall and lip serve as router guides in the trimming stage of manufacture to easily remove the cap 108 and reveal both openings simultaneously.

The platform of FIG. 10 has been shown with an optional feature, where it is desired to use the platform with a peripheral sleeve 109. The sleeve 109 is a four-walled vertically extending element which may be used together with a cap to enclose loose goods. The platform may be provided with a peripheral groove 111 which extends around the top surface of the platform and which is recessed to receive the lower edge of the sleeve 109.

The platform 72 may be engaged by the tines of a forklift truck and transported from place to place. When it is desired to disengage the fork tines from the pallet deck, the tines are tipped upwardly slightly to bring those lower engagement regions 78 farthest from the truck 45 into contact with the floor 70. Because the forklift tines are tapered at the tips, this inclining of the platform drives the tine tips into the channels 80, while the lower engagement regions 78 experience frictional resistance by contact with the floor 70. This frictional resistance serves to hold the platform 72 in place on the floor 70 as the truck 45 continues to withdraw until it is fully separated from the platform 72.

It should be noted that the platform deck 74 has the capability for greater engagement with the floor 70 than a conventional pallet with a deck which is supported above the floor on legs. The channels need only be somewhat wider than the tines themselves, for example about seven inches wide. The proportion of the area of the deck which engages the floor 70 or underlying load may be calculated as follows:

where l is the length of the deck, and w is the width of the deck, and n is the width of a channel:

floor engaging region area=total area of deck−total area of channels $$=lw-(2n(l)+2n(w))+4n^2$$

$$=lw-2n(l+w)+4n^2$$

the proportion of floor engaging region area to total area may be expressed as:

$$\frac{lw - 2n(l + w) + 4n^2}{lw}$$

Thus, in the extreme case of no channels (n=0), it will be seen that the entire deck will engage the floor. In the illustrated platform, in which the channels are about 7 inches wide, and the pallet deck is 40 inches wide by 48 inches long, the proportion which engages the floor is $$\frac{40 \times 48 - 2 \times 7(40 + 48) + 4 \times 7^2}{(40 \times 48)} = 0.46$$

Thus it will be seen that the platform 72 provides nearly 50 percent engagement with the floor. A greater amount of engagement is desirable as it spreads the load of the platform over a greater area and thus has lower stress overall. This is particular desirable when one platform is stacked upon an underlying load, and it is desired to avoid damaging the underlying load.

Figure 11:
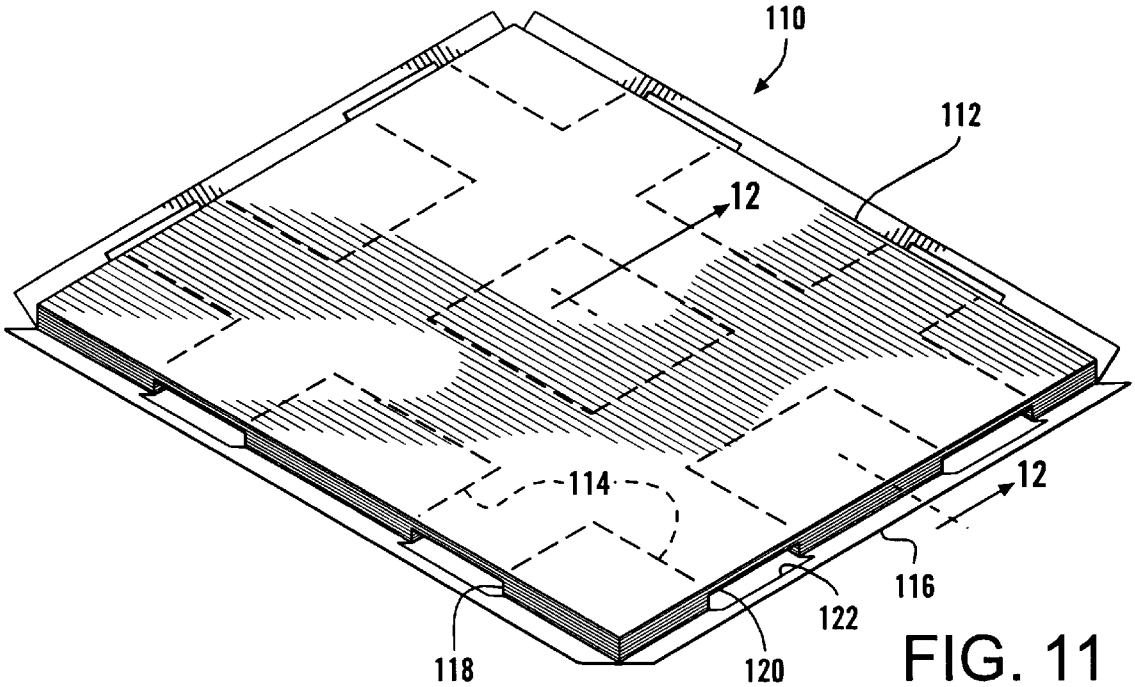
FIG. 11 is a top isometric view of an alternative embodiment load support platform this invention constructed of corrugated paperboard.
Figure 12:
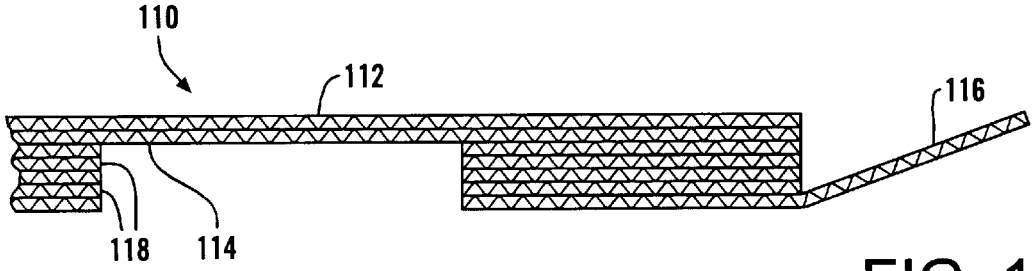
FIG. 12 is a cross-sectional view of the platform of FIG. 11 taken along section line 12—12.

A platform 110 of this invention fabricated of corrugated paperboard sheets is shown in FIGS. 11–12. The platform 110 has a deck 112 comprised of multiple layers of corrugated paperboard adhesively joined together. The channels 114 on the underside of the deck 112 are formed by adhesively connecting smaller corrugated paperboard elements 118 together to define the channels 114 therebetween. The platform 110 has a lip 116, also formed of corrugated paperboard and scored or otherwise folded to extend upwardly and outwardly from the base of the deck 112. The lip 116 extends from tabs which are glued to the smaller corrugated elements 118. The channels extend from tine inlet openings 120. The lips 116 have die-cut tine clearance openings 122.

Figure 13:
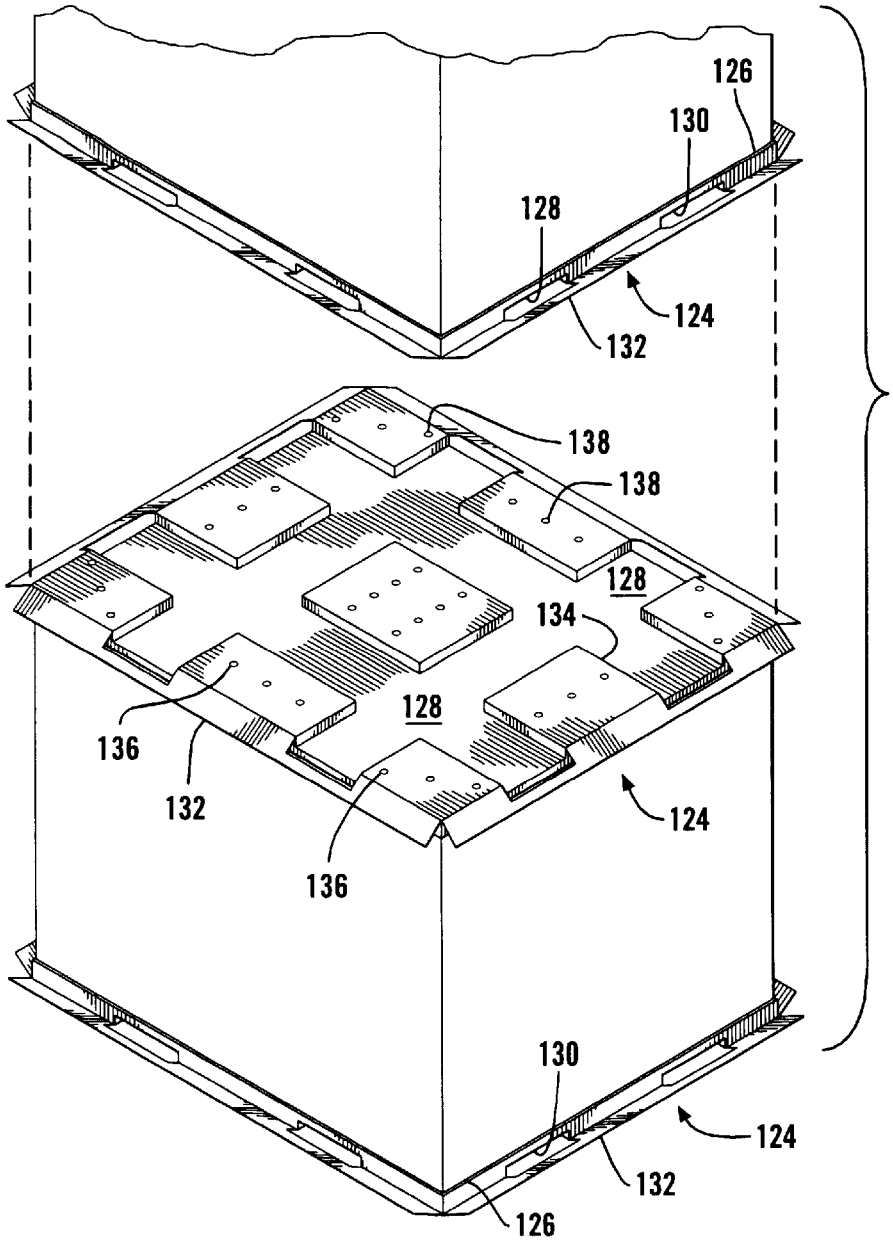
FIG. 13 is an exploded isometric view of two stacked loads employing alternative embodiment load support platforms of this invention constructed of plastic foam.
Figure 14:
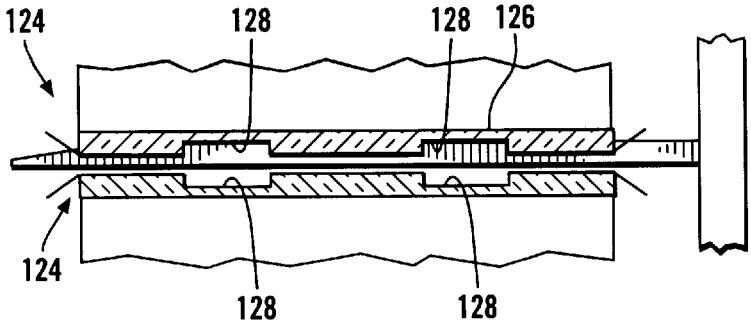
FIG. 14 is a fragmentary cross-sectional view of the stacked loads of FIG. 13, showing the insertion of forklift tines between the two stacked loads.

Another alternative embodiment platform 124 is shown in FIGS. 13–14. The platform 124 is similar in exterior volume to the platform 72, but is formed as a molded foam part. The platform 124 has a deck 126 with recessed channels 128 which extend from tine entry openings 130 and which are not as deep as the forklift tines. A lip 132 extends upwardly and outwardly from the lower engagement regions 134 of the deck. The platform 124 is preferably formed of a resilient foam to provide additional insulation of the load from support surface irregularities and disturbances associated with movement of the platform. The foam could be polyurethane foam, polystyrene, could be generically polymer, could be open or closed cell.

The foam is reinforced at the lip, for example, by inserting a flexible plastic part into the mold prior to foaming, or by placing a thin continuous plastic sheet sheet in the mold, to which foam is added.

The platform 124 may be inverted such that the engagement regions 134 face upwardly, and may thus be used as a load cap. The platform 124 may be strapped or shrink-wrapped to the underlying load. Although not shown in FIG. 13, the engagement regions 134 may be provided with interlocking recesses and projections, so that an overlying platform 124 will mate with the cap and restrict sideward displacement. The recesses 136, and protrusions 138 may take the form of circular depressions or dimples, and circular projections. As shown in FIG. 14, although there is not sufficient depth in one channel to fully receive the forklift tines 48, when the platform of an overlying load is engaged with the underlying, the combined depth of the adjacent channels 128 is sufficient to permit a forklift truck to engage the overlying load on the platform 124 without disturbing the underlying load. Although for clarity the lips of the platform have been illustrated as extending outwardly and downwardly on the cap, in practice the cap will typically be shrink-wrapped or strapped onto the underlying load or to a sleeve supported on the underlying platform.

In conventional 9-leg pallets, which have decks which are spaced 4–5 inches above the floor by legs, a significant level of stress is found in the vertical supporting members, that is the walls of the pallet legs, because there are not very many of them, and because they have extend so high. The platforms disclosed above have a tremendous advantage over leg-elevated pallets, in that the deck itself rests directly on the ground, permitting a great number of vertical members, i.e. the vertically extending walls of the ribs, and allowing those vertical members to be comparatively very short, i.e. from under an inch to about 2–3 inches. The greater performance of plastic in this short vertical members, allows a pallet of a given load support capacity to be manufactured at a greatly reduced price when compared to a conventional 9-leg pallet.

Figure 15:
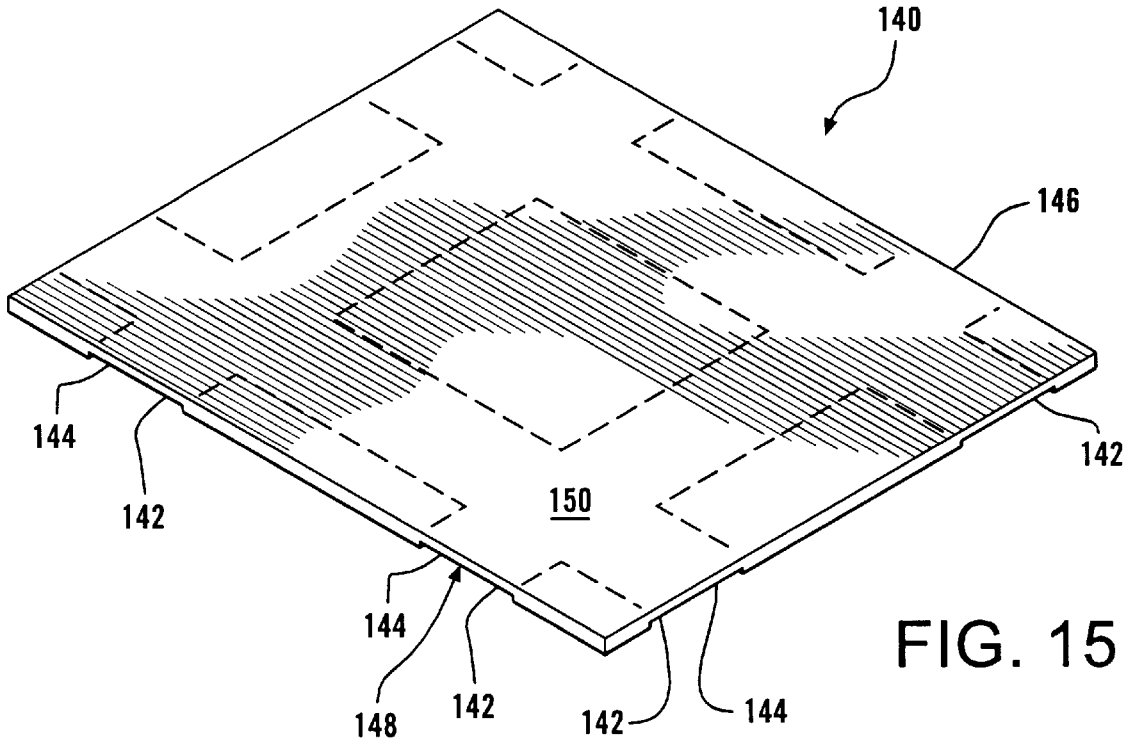
FIG. 15 is an isometric view of a twin sheet thermoformed material handling load support platform of this invention which does not have slip sheet lips.

There is a major cost relationship between height and cost of a material handling platform. Another alternative embodiment platform of this invention is shown in FIG. 15. The platform 140 maybe identical to the platform shown in FIG. 6, with the difference that the lips may be eliminated. Such a platform 140 is adapted exclusively for manipulation by fork lift trucks not having slip-sheet handling accessories. The platform 140 has channels 142 which extend between tine inlet openings 144 on opposite edges of the pallet. As opposed to a conventional 9-leg pallet in which the legs may extend four inches from the floor to the deck, and the deck may be two inches tall, in the platform 140 the channels 142 are about ½ inch deep, while the total deck 146 is about 1.5 inches tall. Thus it will be seen that the platform 140 has protrusions which extend below the tine engagement surfaces 148 of the deck 146 a distance which is less than the distance from the tine engagement surfaces 148 to the top surface 150 of the deck. The platform 140 also has the improved ground contacting surface area as discussed above. The platform 140 may also be made as a single sheet thermoformed part, similar to the part shown in FIG. 1, or as a molded foam part.

It should be noted that strap-receiving grooves may also be provided on the twin sheet thermoformed and foam molded embodiments to perform the functions discussed with respect to FIG. 5. Moreover, the single sheet thermoformed and foam molded embodiments may also be provided with a peripheral groove to receive a pallet sleeve. Also, although only the foam molded embodiment has been illustrated in use as a cap, the other embodiments discussed above may also be used as a cap, and may have the interfitting dimples and protrusions to restrict horizontal movement.

It is understood that the invention is not limited to the particular construction and arrangement of parts herein illustrated and described, but embraces such modified forms thereof as come within the scope of the following claims.

I claim:

1. A material handling support platform comprising a unitary plastic sheet having a plurality of upwardly extending closely spaced ribs, wherein each rib has an upper surface, and the ribs are spaced from one another by valleys having lower portions defining a downwardly facing lower surface, wherein the rib upper surfaces define a generally horizontal support deck for the receipt thereon of a load, and wherein the platform has a perimeter defined between parallel front and rear edges, and two parallel side edges, and wherein a lip extends upwardly and outwardly from each of the front edge, the rear edge, and the two side edges, and wherein two tine entry openings are defined adjacent at least one of the four edges, each tine entry opening comprising a plurality of tapered ribs extending generally perpendicular to said edge, the plurality of tapered ribs defining an inverted ramp which extends away from the support deck as the ramp extends inwardly from said edge, said two tine entry openings being positioned to receive the spaced parallel tines of a fork lift truck.

2. The material handling support platform of claim 1 wherein two tine openings are defined adjacent each of the four edges of the platform, and wherein portions of the downwardly facing lower surface which extend between opposed tine openings on opposite edges define a tine engagement first region, and the remaining portions of the downwardly facing lower surface defining a second region, and wherein the cross-sections of the valleys defining the first region are generally curved.

3. The material handling support platform of claim 2 wherein the cross-sections of the valleys defining the second region are generally square.

4. The material handling support platform of claim 1 wherein the distance between the downwardly facing lower surface and the support deck is between one quarter inch and one inch.

5. The material handling support platform of claim 1 further comprising a flat rib which runs parallel to one of said edges of the platform, extending approximately in the plane of the horizontal support deck, the flat rib receiving thereunder a strap for retaining of a load on the deck.

6. The material handling support platform of claim 1 further comprising a peripheral groove recessed within the horizontal support deck for receipt therein of a pallet sleeve.

7. A material handling support platform comprising:

a load support deck having a top surface which extends horizontally and faces upwardly, wherein the deck has a front edge, a rear edge spaced rearwardly from the front edge, and two spaced side edges extending between the front edge and the rear edge;

a front wall extending downwardly from the front edge;

a rear wall extending downwardly from the rear edge;

side walls extending downwardly from each of the two side edges;

portions of the support deck which are spaced below the top surface and which define lower engagement regions;

at least two tine access openings defined in the front wall, a tine access opening being defined between two ground engagement regions;

at least two tine access openings defined in the rear wall opposite the front wall tine access openings;

at least two downwardly opening channels defined by portions of the support deck, wherein a first channel extends between one of the two tine access openings on the front wall and the opposite tine access opening on the rear wall, and a second channel extends between the other of the two tine access openings and the opposite tine access opening on the rear wall, wherein each channel has a tine engagement surface which faces downwardly and which is spaced above the deck lower engagement regions and below the deck top surface; and a lip which extends upwardly and outwardly from the deck adjacent the front wall, the lip extending at a level below the tine engagement surfaces of the channels, wherein portions of the lip define a clearance opening adjacent each tine access opening in the front wall, to thereby permit two forklift tines to pass through the lip, into the front wall tine access openings and into engagement with the tine engagement surfaces of the first channel and the second channel.

8. The platform of claim 7 further comprising a flat rib which runs parallel to one of said edges of the platform, extending approximately in the plane of the horizontal support deck, the flat rib receiving thereunder a strap for retaining of a load on the deck.

9. The platform of claim 7 further comprising a peripheral groove recessed within the horizontal support deck for receipt therein of a pallet sleeve.

10. The platform of claim 7 wherein the deck is comprised of a two sheets of thermoplastic material fused together in the twin sheet thermoforming process, a plurality of ribs being defined between the two sheets, wherein the spacing between said ribs is less above the tine engagement surfaces, than above the lower engagement regions.

11. The platform of claim 7, wherein the platform is fabricated of a plurality of corrugated paperboard elements.

12. The platform of claim 7 wherein the platform is fabricated of molded plastic foam.

13. A material handling support platform comprising:

a load support deck having a top surface which extends horizontally and faces upwardly, wherein the deck has a front edge, a rear edge spaced rearwardly from the front edge, and two spaced side edges extending between the front edge and the rear edge;

a front wall extending downwardly from the front edge;

a rear wall extending downwardly from the rear edge;

side walls extending downwardly from each of the two side edges;

portions of the support deck which are spaced below the top surface and which define lower engagement regions;

at least two tine access openings defined in the front wall, a tine access opening being defined between two ground engagement regions;

at least two tine access openings defined in the rear wall opposite the front wall tine access openings; and at least two downwardly opening channels defined by portions of the support deck, wherein a first channel extends between one of the two tine access openings on the front wall and the opposite tine access opening on the rear wall, and a second channel extends between the other of the two tine access openings and the opposite tine access opening on the rear wall, wherein each channel has a tine engagement surface which faces downwardly and which is spaced above the deck lower engagement regions and below the deck top surface, wherein the distance between the lower engagement regions and the tine engagement surfaces is less than two inches, and less than the height of a forklift tine which is to be interposed into the channels, such that the platform deck lower engagement regions are spaced above a support surface when forklift tines are engaged with the deck lower engagement regions and the support surface.

14. The platform of claim 11, wherein the ratio of the area of the deck lower engagement regions to the total area of the deck having a length l and a width w, where the width of each channel is n, is defined by the relation.

$$\frac{lw - 2n(l + w) + 4n^2}{lw}.$$

* * * * *